US007348960B2

(12) United States Patent
Huang et al.

(10) Patent No.: US 7,348,960 B2
(45) Date of Patent: Mar. 25, 2008

(54) BACKLIGHT DEVICE AND METHOD FOR CONTROLLING LIGHT SOURCE BRIGHTNESS THEREOF

(75) Inventors: Li-Ren Huang, Taipei County (TW); Chung-Wei Lin, Pingtung County (TW); Chin-Ching Yeh, Hsincu County (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 11/463,011

(22) Filed: Aug. 8, 2006

(65) Prior Publication Data

US 2007/0257869 A1 Nov. 8, 2007

(30) Foreign Application Priority Data

May 5, 2006 (TW) ..... 95116005 A

(51) Int. Cl.
*G09G 3/34* (2006.01)

(52) U.S. Cl. ..... 345/102; 315/307; 315/291; 315/158

(58) Field of Classification Search ..... 315/209 R, 315/224, 291, 149–159, 169.3, DIG. 4; 345/102, 345/82

See application file for complete search history.

(56) References Cited

U.S. PATENT DOCUMENTS

| | | | | |
|---|---|---|---|---|
| 6,127,783 | A | 10/2000 | Pashley et al. | |
| 6,495,964 | B1 | 12/2002 | Muthu et al. | |
| 6,753,661 | B2 | 6/2004 | Muthu et al. | |
| 6,894,442 | B1 | 5/2005 | Lim et al. | |
| 2003/0174369 | A1 * | 9/2003 | Sato et al. | 358/509 |
| 2006/0181224 | A1 * | 8/2006 | Gibson et al. | 315/209 R |
| 2007/0040517 | A1 * | 2/2007 | Yu | 315/291 |

* cited by examiner

*Primary Examiner*—Douglas W. Owens
*Assistant Examiner*—Ephrem Alemu
(74) *Attorney, Agent, or Firm*—Jianq Chyun IP Office

(57) ABSTRACT

A backlight device includes a light source module having a plurality of light sources, a detecting circuit, a control unit, and a pulse width modulation (PWM) driving circuit. The detecting circuit is used for detecting the brightness of the light source module and generating a detecting signal to the control unit, such that the control unit outputs a control signal according to the detecting signal. In addition, the PWM driving circuit is used for generating a PWM signal for driving the light source module. In the present invention, the PWM driving circuit adjusts the base frequency of the PWM signal according to the control signal without adjusting the duty cycle of the PWM signal, so as to control the brightness of the light sources.

13 Claims, 8 Drawing Sheets

BACKLIGHT DEVICE AND METHOD FOR CONTROLLING LIGHT SOURCE BRIGHTNESS THEREOF

CROSS-REFERENCE TO RELATED APPLICATION

This application claims the priority benefit of Taiwan application serial no. 95116005, filed on May 5, 2006. All disclosure of the Taiwan application is incorporated herein by reference.

BACKGROUND OF THE INVENTION

1. Field of Invention

The present invention relates to a method for controlling light source. More particularly, the present invention relates to a method for controlling the light source brightness of a backlight device.

2. Description of Related Art

Before being dispatched from the factory, light-emitting diode (LED) backlight devices should be adjusted to the optimum by the manufacturer. However, the property of LEDs varies along with temperature and service life, such that the driving current designed by the manufacturer for driving the LED cannot make the backlight device to generate desired luminous effect. Therefore, many patents directed to solve the above problem are issued, such as U.S. Pat. No. 6,894,442, U.S. Pat. No. 6,127,783, and U.S. Pat. No. 6,495,964.

FIG. 1 is a circuit block diagram of the conventional backlight device. Referring to FIG. 1, a backlight device 100 comprises a light source module 110 having a plurality of LED light sources 112 and a frequency-varied pulse width modulation (FPWM) unit 122 for generating a PWM signal Vp to drive the light source module 110.

In the conventional backlight device 100, a detection module 130 is used to detect the luminous brightness of the light source module 110, and generates a current Id signal to an analog-to-digital converter (ADC) 144 via a limited current circuit 142. In general, the detection module 130 has a plurality of light detectors 132.

When receiving the output of the limited current circuit 142, the ADC 144 converts the analog current signal into a digital control frequency signal D1 and sends the digital control frequency signal D1 to the control unit 146. Then, the control unit 146 converts the digital control frequency signal into an analog control voltage Vc and sends the analog control voltage Vc to an input end of a frequency comparator 148. At this time, the frequency comparator 148 compares the control voltage Vc with a comparison voltage Vs from a variable resistor 152 connected in series to the light source module 110 and sends the comparison result to the FPWM unit 122.

The FPWM unit 122 generates the PWM signal Vp according to the output of a phase lock loop (PLL) 150. The FPWM unit 122 adjusts the duty cycle range of the PWM signal Vp according to the output of the frequency comparator 148. As shown in FIG. 2, C1 indicates an original PWM signal. When the brightness of the light source module 110 is weakened, the control voltage Vc is less than the comparison voltage Vs. At this time, the FPWM unit 122 increases the duty cycle of the PWM signal Vp as shown by C2, so as to increase the driving current of the light source module 110. On the contrary, the FPWM unit 122 can also reduce the duty cycle of the PWM signal Vp as shown by C3, so as to reduce the driving current of the light source module 110.

SUMMARY OF THE INVENTION

Accordingly, the present invention provides a circuit for controlling the light source brightness, so as to dynamically adjust the brightness of the backlight device applied to a liquid crystal panel. As for an LED backlight device, the PWM signal for driving the LED belongs to a frequency domain signal, so the present invention directly adjusts the base frequency of the PWM signal instead of adjusting the duty cycle of the PWM signal in the conventional art, so as to control the brightness of the backlight device.

In another viewpoint, the present invention provides a backlight device, which adopts the aforementioned control circuit.

In another viewpoint, the present invention provides a method for controlling the light source brightness, which can also be used to dynamically control the brightness of the backlight device.

The circuit for controlling the light source brightness of the present invention comprises a frequency comparator, a PLL, and a FPWM unit. The frequency comparator is used to receive a detecting frequency signal and a reference frequency value, and the detecting frequency signal is obtained by detecting the brightness of a plurality of light sources. The PLL generates a control frequency signal to the FPWM unit according to the output of the frequency comparator, such that the FPWM unit adjusts the base frequency of the PWM signal according to the control frequency signal without adjusting the duty cycle of the PWM signal, so as to control the brightness of the light sources.

The backlight device provided by the present invention comprises a light source module having a plurality of light sources, a detecting circuit, a control unit, and a PWM driving circuit. The detecting circuit is used for detecting the brightness of the light source module and generating a detecting frequency signal to the control unit, such that the control unit outputs a control frequency signal according to the detecting frequency signal. In addition, the PWM driving circuit is used for generating a PWM signal for driving the light source module. In the present invention, the PWM driving circuit adjusts the base frequency of the PWM signal according to the control frequency signal without adjusting the duty cycle of the PWM signal, so as to control the brightness of the light sources.

The method for controlling the light source brightness provided by the present invention comprises generating a PWM signal to drive a plurality of light sources. Further, the brightness of the light sources is detected to generate a detection result, such that the present invention can adjust the base frequency of the PWM signal according to the detection result without adjusting the duty cycle of the PWM signal, so as to control the brightness of the light sources.

In an embodiment of the present invention, the above-mentioned light sources can be LEDs including red, green and blue LEDs.

As the base frequency of the PWM signal is directly controlled in the present invention, processes of analog-to-digital and digital-to-analog conversions are omitted. Therefore, the cost of the backlight device can be reduced.

In order to make the aforementioned and other objects, features and advantages of the present invention comprehensible, preferred embodiments accompanied with figures are described in detail below.

DESCRIPTION OF EMBODIMENTS

Figure 1:
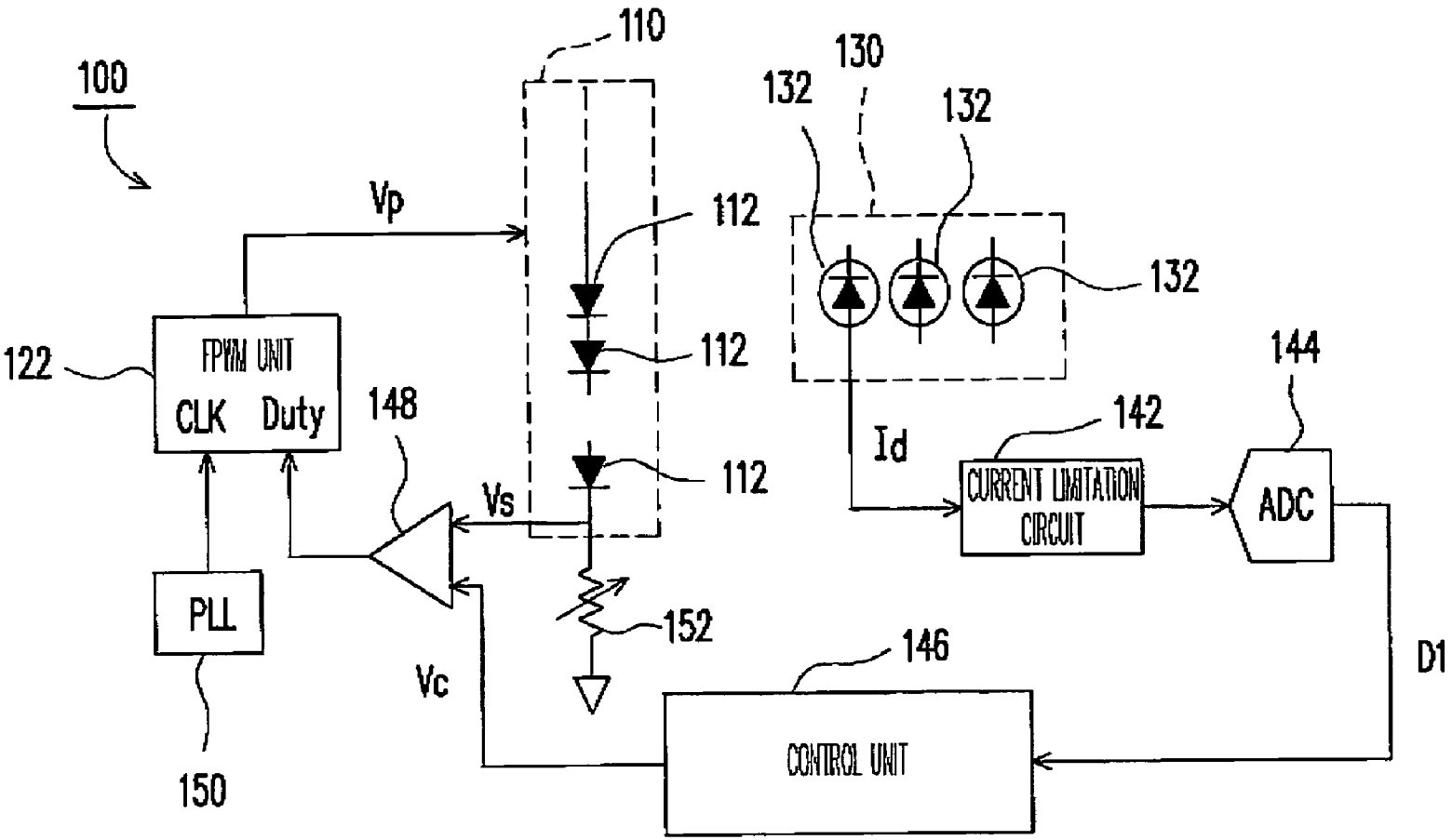
FIG. 1 (PRIOR ART)
FIG. 1 is a circuit block diagram of the conventional backlight device.
Figure 2:
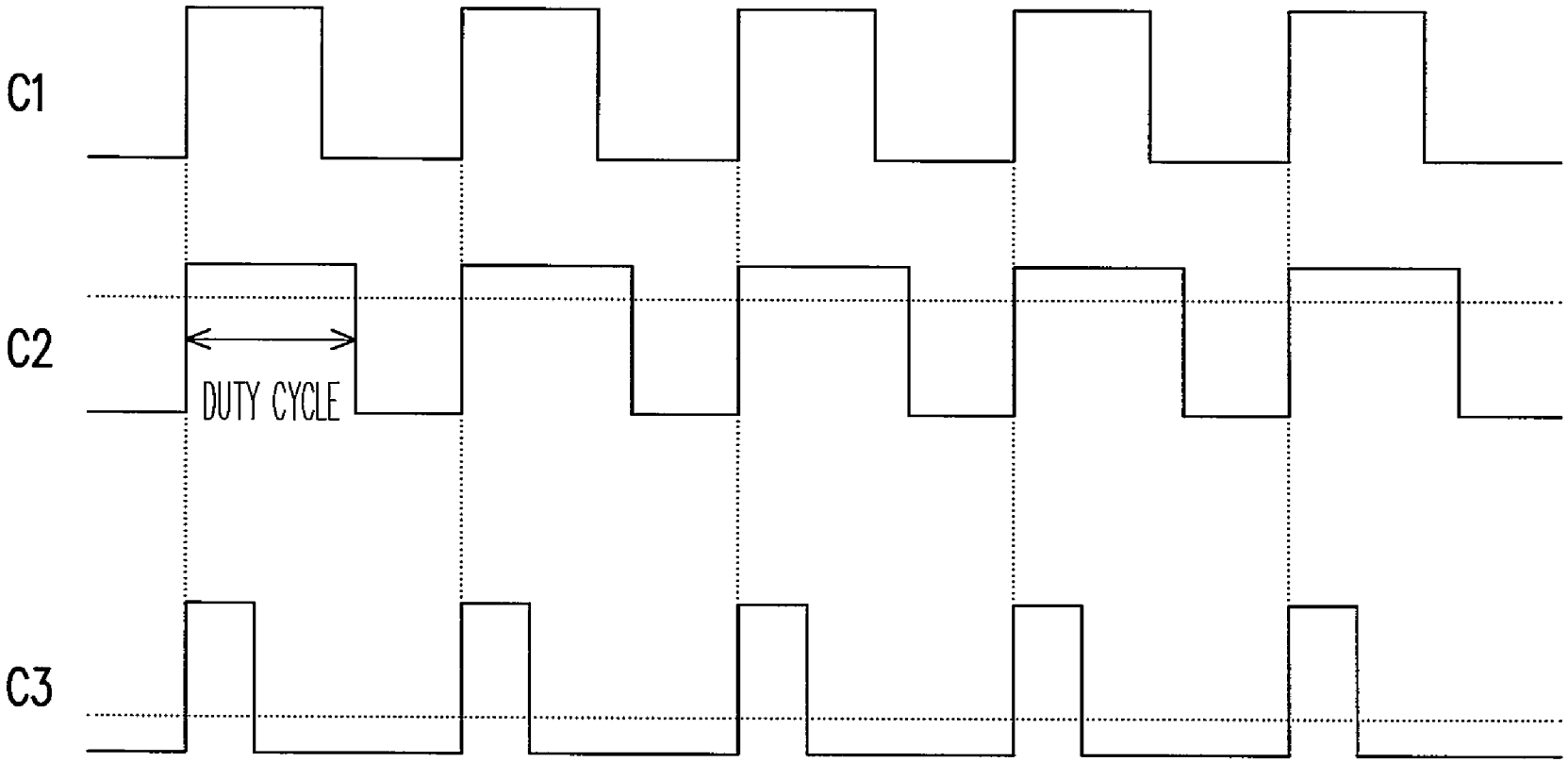
FIG. 2 (PRIOR ART)
FIG. 2 is a timing diagram of adjusting the duty cycle of the PWM signal.
Figure 3:
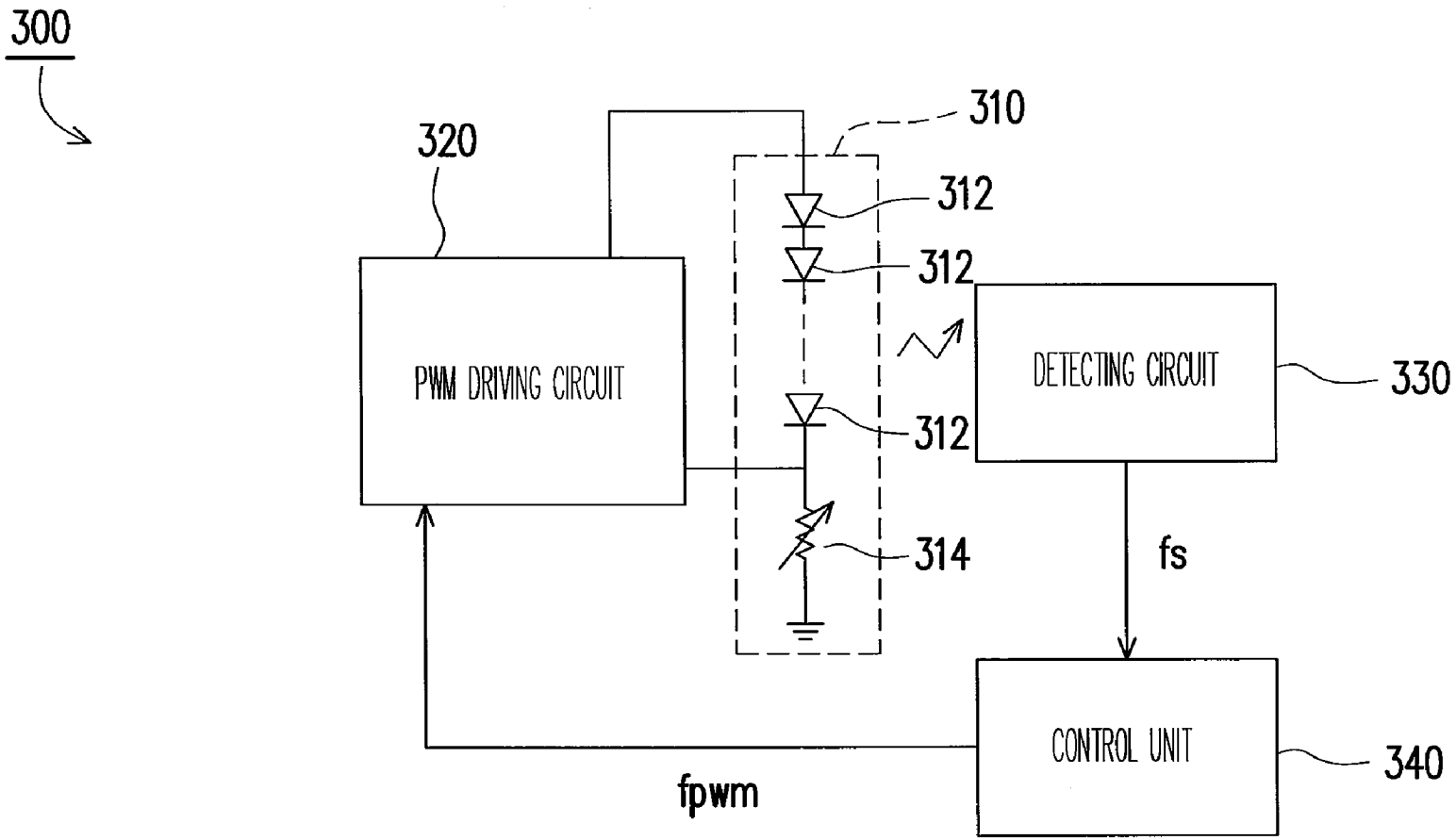
FIG. 3 is a circuit block diagram of a backlight device according to a preferred embodiment of the present invention.

FIG. 3 is a circuit block diagram of the backlight device according to a preferred embodiment of the present invention. Referring to FIG. 3, a backlight device 300 provided by the present invention comprises a light source module 310 having a plurality of light sources 312, a PWM driving circuit 320, a detecting circuit 330, and a control unit 340.

Figure 4:
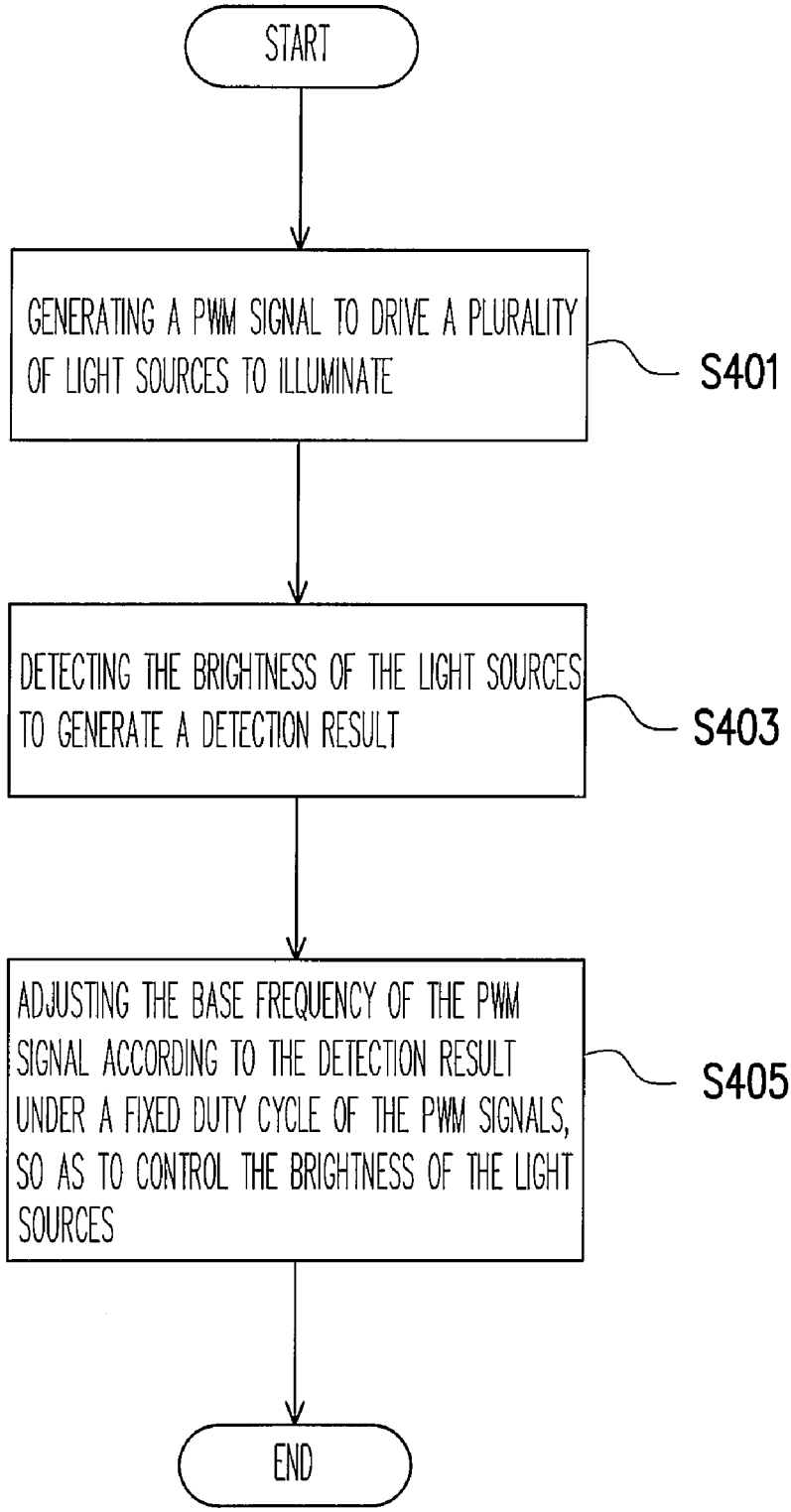
FIG. 4 is a flow chart of the method for controlling the light source brightness according to a preferred embodiment of the present invention.

FIG. 4 is a flow chart of the method for controlling the light source brightness according to a preferred embodiment of the present invention. Referring to FIGS. 3 and 4 together, in Step S401, the PWM driving circuit 320 generates a PWM signal to drive the light sources 312 in the light source module 310 to illuminate. In other preferred embodiments, the light sources 312 can be LEDs of different colors, such as red, blue, and green LEDs.

When the light source module 310 is driven, the detecting circuit 330 detects the luminous brightness of the light source module 310 as described in Step S403, and the detected brightness is converted into a detecting frequency signal fs to the control unit 340. The control unit 340 then outputs a control frequency signal fpwm to the PWM driving circuit 320 according to the detecting frequency signal fs, such that the PWM driving circuit 320 can adjust the base frequency of the PWM signal according to the control frequency signal fpwm under the fixed duty cycle of the PWM signal as described in Step S405, so as to control the brightness of the light source module 310.

Figure 5:
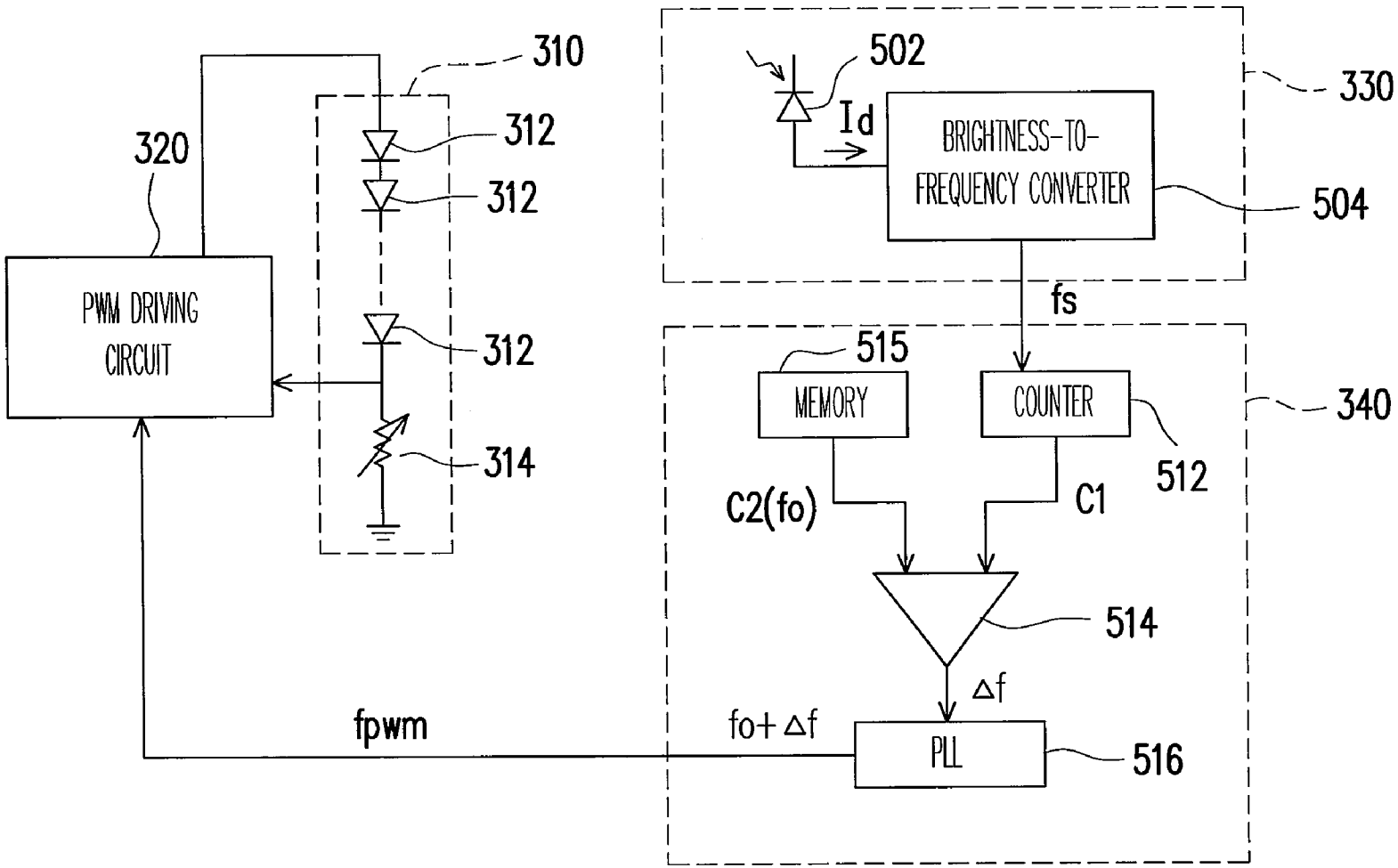
FIG. 5 is a circuit block diagram of the detecting circuit and the control unit in FIG. 3 according to a preferred embodiment of the present invention.

FIG. 5 is a circuit block diagram of the detecting circuit and the control unit in FIG. 3 according to a preferred embodiment of the present invention. Referring to FIG. 5, the detecting circuit 330 comprises an light detector 502 and a brightness-to-frequency converter 504. The light detector 502 is used to detect the brightness of the light source module 310 and generate a current Id. The brightness-to-frequency converter 504 is used to receive and convert the current Id into the detecting frequency signal fs to the control unit 340. Therefore, the detecting frequency signal fs varies along with the current Id, and the current Id further varies along with the brightness of the light source module 310 detected by the light detector 502.

When the detecting frequency signal fs is sent by the detecting circuit 330 to the control unit 340, a counter 512 in the control unit 340 begins to count the detecting frequency signal fs and generates a count frequency value C1 to a frequency comparator 514. At this time, the frequency comparator 514 compares the count frequency value C1 with the reference frequency value C2 stored in the memory 515, and outputs a comparison result Δf to a PLL 516, such that the PLL 516 can output a control frequency signal fpwm to the PWM driving circuit 320. The reference frequency value C2 can correspond to a preset frequency fo, and the reference frequency value C2 is a factory default of the light source device. In the present embodiment, the control frequency signal fpwm is generated by mixing the factor default fo and the comparison result Δf.

Figure 6:
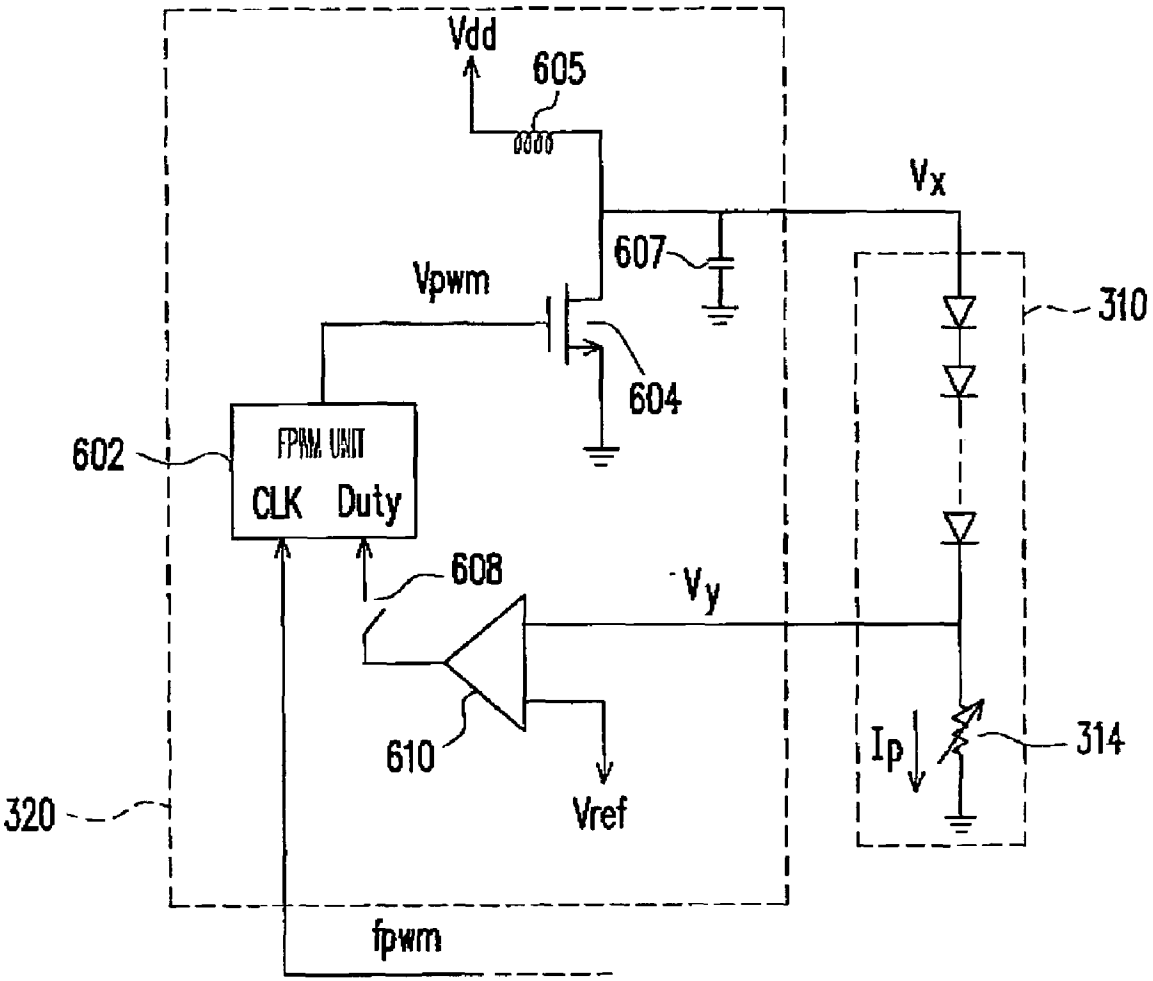
FIG. 6 is a circuit block diagram of the PWM driving circuit in FIG. 3 according to a preferred embodiment of the present invention.

FIG. 6 is a circuit block diagram of the PWM driving circuit of FIG. 3 according to a preferred embodiment of the present invention. Referring to FIG. 6, the PWM driving circuit 320 has a FPWM unit 602 for generating a PWM signal Vpwm to a gate of a transistor 604. In the present embodiment, a first source/drain of the transistor 604 is connected to ground and a second source/drain thereof is coupled to the light source module 310 for generating a driving voltage Vx to the light source module 310. In addition, the second source/drain of the transistor 604 is coupled to a voltage source Vdd via an inductor 605 and is connected to ground via a capacitor 607.

When the control frequency signal fpwm is sent to the PWM driving circuit 320, the FPWM unit 602 adjusts the base frequency of the PWM signal Vpwm according to the control frequency signal fpwm under the fixed duty cycle of the PWM signal Vpwm, such that the value of the driving voltage Vx generated by the transistor 604 can be controlled. At this time, as the voltage drop of the LED light sources is a constant value, the operating voltage Vy thereof varies, such that a current Ip (which is the driving current of the light source module in the present embodiment) flowing through a resistor 314 varies accordingly, so as to control the brightness of the light source module 310.

Figure 7:
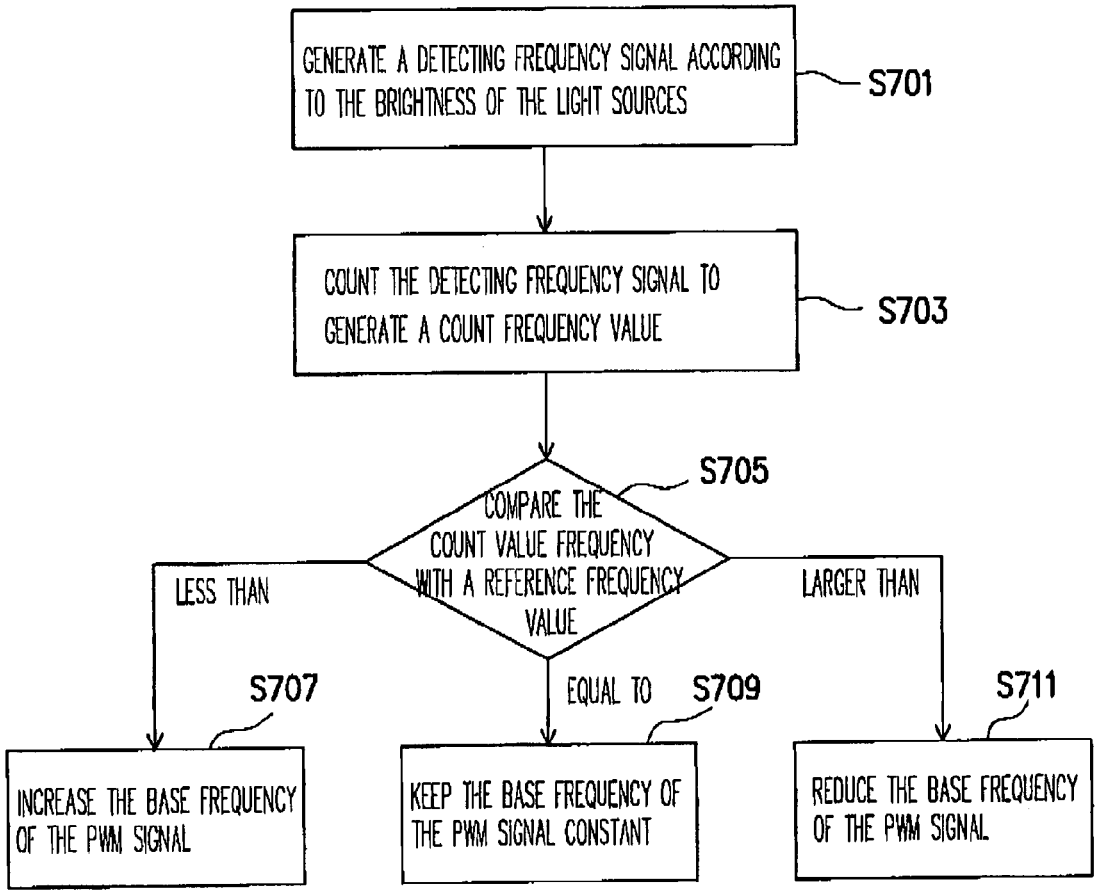
FIG. 7 is a flow chart for adjusting the base frequency of the PWM signal according to a preferred embodiment of the present invention.
Figure 8:
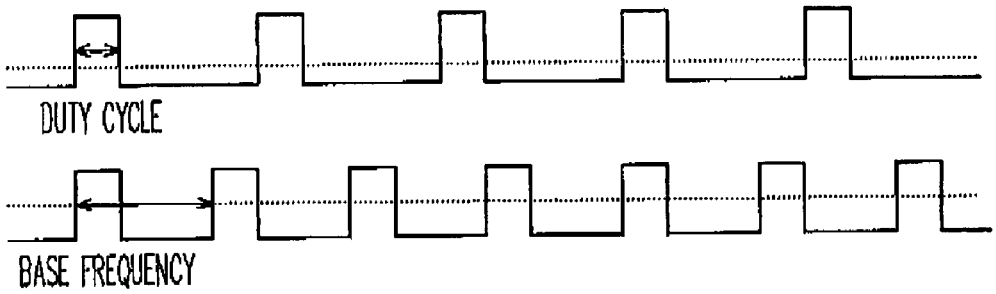
FIG. 8 is a schematic view of increasing the base frequency of the PWM signal according to a preferred embodiment of the present invention.

FIG. 7 is a flow chart illustrating the steps of adjusting the PWM signal according to a preferred embodiment of the present invention. Referring to FIG. 7, when the detecting circuit 330 of FIG. 5 generates a detecting frequency signal fs according to the brightness of the light sources 312 as described in Step S701, the counter 512 counts the detecting frequency signal fs and generates a count frequency value C1 to the frequency comparator 514 as described in Step S703. At this time, the frequency comparator 514 compares the count frequency value C1 with a reference frequency value C2. When the comparison result shows the count frequency value C1 being less than the reference frequency value C2, the brightness of the light source module 310 has been gradually reduced. At this time, for example, the FPWM unit 602 of FIG. 6 increases the base frequency of the PWM signal as described in Step S707. As shown in FIG. 8, the driving current Ip of the light source module 310 can be increased by increasing the base frequency of the PWM signal.

Further, if the comparison result shows that the count frequency value C1 is equal to the reference frequency value C2, the FPWM unit 602 keeps the base frequency of the PWM signal constant as described in Step S709. At this time, the value of the driving current Ip of the light source module 310 keeps constant. Similarly, if the count frequency value C1 is larger than the reference frequency value C2, the FPWM unit 602 reduces the base frequency of the PWM signal as described in Step S711.

Figure 9:
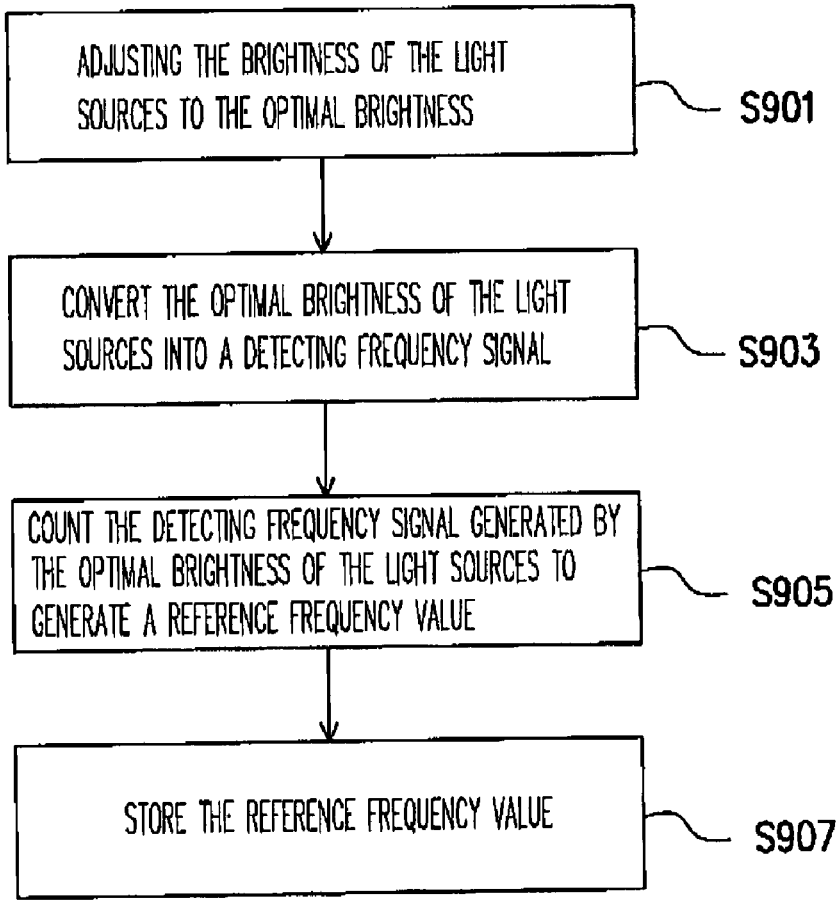
FIG. 9 is a flow chart for setting the reference frequency value according to a preferred embodiment of the present invention.

FIG. 9 is a flow chart illustrating the steps of setting the reference frequency value according to a preferred embodiment of the present invention. Referring to FIGS. 6 and 9 together, the PWM driving circuit 320 further comprises a switch 608 for deciding whether the output of the frequency comparator 610 is coupled to the FPWM unit 602 or not. In addition, one input end of the frequency comparator 610 receives the operating voltage Vy of the light source module 310 and the other input end receives a reference voltage Vref.

When the backlight device 300 is being dispatched from the factory, the testing technician can at first turn on the switch 608. Then, Step S901 is performed by adjusting the variable resistor 314, i.e., adjusting the brightness of the light sources to the optimal brightness. The control unit 340 outputs a preset base frequency fo of the PWM signal as the output of the fpwm. At this time, for example, the detecting circuit 330 of FIG. 5 detects the optimal brightness and generates a detecting frequency signal fs to the counter 512 as described in Step S903. The counter 512 then counts the detecting frequency signal fs generated by the optimal brightness of the light source module 310 and generates a reference frequency value C2 as described in Step S905. Next, the counter 512 stores the reference frequency value C2 into the memory 515, and the value C2 corresponds to the factory default of the base frequency of the PWM signal of the backlight device. Then, the testing technician can turn off the switch 608.

In view of the above, as the present invention directly adjusts the base frequency of the PWM signal to control the brightness of the light source module, the continual analog-to-digital conversions are not required. Thus, the signals processed in the present invention are almost digital signals, so the control unit in the present invention can be accomplished in the manner of digital form, thereby effectively saving the cost of the backlight device of the present invention.

Though the present invention has been disclosed above by the preferred embodiments, they are not intended to limit the present invention. Anybody skilled in the art can make some modifications and variations without departing from the spirit and scope of the present invention. Therefore, the protecting range of the present invention falls in the appended claims.

What is claimed is:

1. A circuit for controlling the light source brightness, comprising:

a frequency comparator, for receiving a detecting frequency signal and a reference frequency value, wherein the detecting frequency signal is obtained by detecting the brightness of a plurality of light sources;

a phase lock loop (PLL), generating a control frequency signal according to an output of the frequency comparator; and a frequency-varied pulse width modulation (FPWM) unit, for outputting a PWM signal to drive the light sources, wherein the FPWM unit adjusts a base frequency of the PWM signal according to the control frequency signal under a fixed duty cycle of the PWM signal, so as to control the brightness of the light sources.

2. The circuit for controlling the light source brightness according to claim 1, wherein the light sources comprise LEDs of different colors.

3. The circuit for controlling the light source brightness according to claim 2, wherein the light sources comprise red, blue, and green LEDs.

4. The circuit for controlling the light source brightness according to claim 1, further comprising a memory for storing a reference frequency value.

5. A backlight device, comprising:

a light source module, having a plurality of light sources;

a detecting circuit, for detecting the brightness of the light source module and generating a detecting frequency signal;

a control unit, for outputting a control frequency signal according to the detecting frequency signal; and a PWM driving circuit, for generating a PWM signal to drive the light source module, wherein the PWM driving circuit adjusts a base frequency of the PWM signal according to the control frequency signal under a fixed duty cycle of the PWM signal, so as to control the brightness of the light sources.

6. The backlight device according to claim 5, wherein the light sources comprises red, blue, and green LEDs.

7. The backlight device according to claim 5, wherein the detecting circuit comprises:

a light detector, for detecting the brightness of the light sources; and a brightness-to-frequency converter, for receiving the output of the light detector and generating the detecting frequency signal to the control unit.

8. The backlight device according to claim 5, wherein the control unit comprises:

a counter, for counting the detecting frequency signal and generating a count frequency value;

a memory, for storing a first reference frequency value;

a first frequency comparator, for receiving the output of the counter and the memory and comparing the count frequency value with the first reference frequency value; and a PLL, for generating the control frequency signal to the PWM driving circuit according to the output of the first frequency comparator.

9. The backlight device according to claim 5, wherein the PWM driving circuit comprises:

a FPWM unit, for adjusting the base frequency of the PWM signal according to the control frequency signal;

a transistor, having a gate receiving the PWM signal, a first source/drain connected to ground, and a second source/drain coupled to the light source module;

an inductor, having a first end coupled to a voltage source, and a second end coupled to the second source/drain of the transistor; and a capacitor, having a first end coupled to the second source/drain of the transistor and a second end connected to ground.

10. The backlight device according to claim 9, wherein the PWM driving circuit further comprises:

a second frequency comparator, for receiving an operating voltage and a second reference frequency value of the light source module; and a switch, for deciding whether the output of the second frequency comparator is coupled to the FPWM unit or not.

11. A method for controlling a light source brightness, comprising:

generating a PWM signal to drive a plurality of light sources;

detecting the brightness of the light sources and generating a detection result; and adjusting a base frequency of the PWM signal according to the detection result under a fixed duty cycle of the PWM signal, so as to control the brightness of the light sources.

12. The method for controlling the light source brightness according to claim 11, wherein the step of adjusting the base frequency of the PWM signal comprises:

generating a detecting frequency signal according to the brightness of the light sources;

counting the detecting frequency signal to generate a count frequency value;

detecting whether the count frequency value is less than a reference frequency value or not, wherein the reference frequency value indicates the optimal brightness of the light sources;

when the count frequency value is less than the reference frequency value, increasing the base frequency of the PWM signal;

when the count frequency value equals to the reference frequency value, keeping the base frequency of the PWM signal constant; and when the count frequency value is larger than the reference frequency value, reducing the base frequency of the PWM signal.

13. The method for controlling the light source brightness according to claim 12, wherein the step of generating the reference frequency value comprises:

adjusting the brightness of the light sources to the optimal brightness;

converting the optimal brightness of the light sources into the detecting frequency signal;

counting the detecting frequency signal generated by the optimal brightness of the light sources to generate the reference frequency value; and storing the reference frequency value.

* * * * *